US005111748A

United States Patent [19]

Thurner et al.

[11] Patent Number: 5,111,748

[45] Date of Patent: May 12, 1992

[54] SUBMUNITION DEPLOYABLE THROUGH AN ARTILLERY PROJECTILE

[75] Inventors: Gunther Thurner, Schwaig; Helmut Hammer, Heroldsberg, both of Fed. Rep. of Germany

[73] Assignee: DIEHL GmbH & Co., Nuremberg, Fed. Rep. of Germany

[21] Appl. No.: 604,870

[22] Filed: Oct. 29, 1990

[30] Foreign Application Priority Data

Nov. 14, 1989 [DE] Fed. Rep. of Germany ..... 3937762

[51] Int. Cl.[5] ..... F42B 12/58

[52] U.S. Cl. ..... 102/387; 102/393; 102/489

[58] Field of Search ..... 102/339, 340, 387, 393, 102/489

[56] References Cited

U.S. PATENT DOCUMENTS

| | | | |
|---|---|---|---|
| 3,946,672 | 3/1976 | Adams et al. | 102/393 |
| 4,013,009 | 3/1977 | Claude et al. | 102/339 |
| 4,333,400 | 6/1982 | McNelia et al. | 102/387 |
| 4,372,215 | 2/1983 | Crepin | 102/387 |
| 4,498,393 | 2/1985 | Fischer et al. | 102/393 |
| 4,587,902 | 5/1986 | Lindner et al. | 102/213 |
| 4,651,648 | 3/1987 | Alon | 102/387 |
| 4,753,171 | 6/1988 | Stessen | 102/387 |
| 4,807,533 | 2/1989 | von Entress-Fürsteneck | 102/489 |
| 4,953,813 | 9/1990 | Postler et al. | 102/339 |

FOREIGN PATENT DOCUMENTS 3435420 3/1986 Fed. Rep. of Germany .

*Primary Examiner*—David H. Brown

*Attorney, Agent, or Firm*—Scully, Scott, Murphy & Presser

[57] ABSTRACT

Submunition which is deployable through the intermediary of an artillery projectile, and in which the submunition includes a releasing device for a braking parachute which is stowed in the tail end region of the submunition. The releasing device is activatable through the intermediary of a retarding element which, in turn, is releasable in dependence upon the exit of the submunition from the casing of the carrier projectile.

6 Claims, 2 Drawing Sheets

SUBMUNITION DEPLOYABLE THROUGH AN ARTILLERY PROJECTILE

BACKGROUND OF THE INVENTION

1. Field of the Invention

The present invention relates to submunition which is deployable or deliverable to a target object through the intermediary of an artillery projectile, and in which the submunition includes a releasing device for a braking parachute which is stowed in the tail end region of the submunition.

2. Discussion of the Prior Art

An arrangement of that type is, in general, known from the disclosure of U.S. Pat. No. 4,807,533 which is assigned to the common assignee of the present application. In that particular instance, an article of submunition which includes a braking parachute stowed in a rearwardly located cassette is located in front of the base of the carrier projectile and which is adapted to be sheared off from the casing of the carrier, and arranged in front of this rear submunition there is located at least one further article of submunition (hereinafter referred to as the forward submunition). The coaxial stack of articles of submunition is dispensed rearwardly from the carrier casing during the overflight of the carrier projectile above the target area due to the separation of the base therefrom. This can be effectuated through the intermediary of parachute pull lines, such as illustrated in the disclosure of U.S. Pat. No. 4,372,215. Nevertheless, it is more expedient to push the coaxial stack consisting of the base and the articles of submunitions arranged in front thereof, out of the casing through the action of a gas generator which is located in front of the articles of submunition.

In order to pull the braking parachute of the rear article of submunition out of the packing cassette, there is expediently provided a pull line which is attached to the aerodynamically-braked base, such as is described in more specific detail in U.S. Pat. No. 4,753,171, which is also assigned to the common assignee of the present application and the disclosure of which is incorporated by reference herein. When a corresponding line is provided extending from the leading end of the rearward article of submunition to the packing for the braking parachute in the tail end of the submunition located in front thereof, which should tension itself due to the braking down of the rear article of submunition, in order to pull out the packed parachute and then draw the packing away therefrom to then allow the parachute to open, then for this purpose there is provided a mechanical coupling between the two adjoining articles of submunition, which can hinder the intended undisturbed kinematic sequences. In particular, this line must be constructed extremely lengthy in order to ensure the presence of a sufficient distance between the forward and the rear articles of submunition prior to the unfolding of braking parachute of the forward submunition without thereby colliding with the already braked rear article of submunition. Before the articles of submunition have been axially raised away from each other, the lengthy line must be stowed within a narrow amount of space and secured against any premature looping or pitching out through the use of a strong safety yarn. From the beginning of the looping out until the tensioning of this pull line, there is accordingly encountered the danger of mechanical damage thereto between the tail end of the forward and the end surfaces of the rear articles of submunition prior to both of these having been sufficiently raised away from each other. Moreover, a pull line of such extensive length can be uncoiled from the rear article of submunition while the latter is still rotating at a high rate of speed under the influence of the stabilizing spin, so that the shroud lines of the rear braking parachute will either wind in or tangle and the parachute will lose its braking effectiveness, or possible the forward braking parachute will be wound about the rear article of submunition or its parachute, so as to cause both articles of submunition to ineffectively crash or tumble down.

SUMMARY OF THE INVENTION

In recognition of these conditions which are encountered in the technology, it is an object of the present invention to ensure an undisturbed sequence in presently the separating and braking kinematics of a forward article of submunition in relation to a (previously braked) article of submunition located rearwardly thereof.

The foregoing object is inventively attained in that, in addition to the measures considered hereinabove, the releasing device is activatable through the intermediary of a restraining or retarding element which, in turn, is releasable in dependence upon the exit of the submunition from the casing of the carrier projectile.

In accordance with the foregoing object, the opening of the braking parachute of the forward or leading submunition is retarded without the additional aid of a pull line which must first be tensioned as a mechanical coupling between the articles of submunition. Avoided thereby are disturbing interactions during the respective transition into the parachute-braked descending flight, and in particular, the forward braking parachute is only then dispensed (and thereby released for extension and unfolding), when there is present a sufficient distance from the already previously braked rear article of submunition. The kinematic operating sequence for each and every article of submunition is implemented independently from the other so that, especially, a braking parachute which is being later on unfolded or opened can no longer collide with the already previously braked system. Inasmuch as the release of the successive braking parachute system is not carried out through any mechanical coupling to the precedingly already braked submunition, there are also avoided all operational disturbances which can be possibly encountered; for instance, such as from an irregular stretching out of the pull line or from the destruction thereof caused by any interactions taking place between both articles of submunition prior to their final lifting away from each other.

It is particularly expedient when, as the retarding or restraint element for the autonomous release of the braking parachute of the forward submunition, there is employed a mechanical retarding mechanism which is operated under the influence of spin-generated centrifugal forces so that the period of retarding will vary in dependence upon the intended mission. Especially with a lesser firing charge, in effect, at a lower firing or muzzle velocity for the carrier projectile from the rifled weapon barrel, is there an increase in the time interval between the discharge of the submunition from the carrier projectile up to the release of its braking parachute, in order to constantly ensure the presence of a sufficient distance from the already previously braked submunition which is located rearwardly thereof, prior to the extension of the next parachute.

BRIEF DESCRIPTION OF THE DRAWINGS

Additional alternatives and modifications, as well as further features and advantages of the invention, can now be more readily ascertained from the following detailed description of an exemplary embodiment thereof, taken in conjunction with the accompanying drawings; in which.

DETAILED DESCRIPTION

Figure 1:
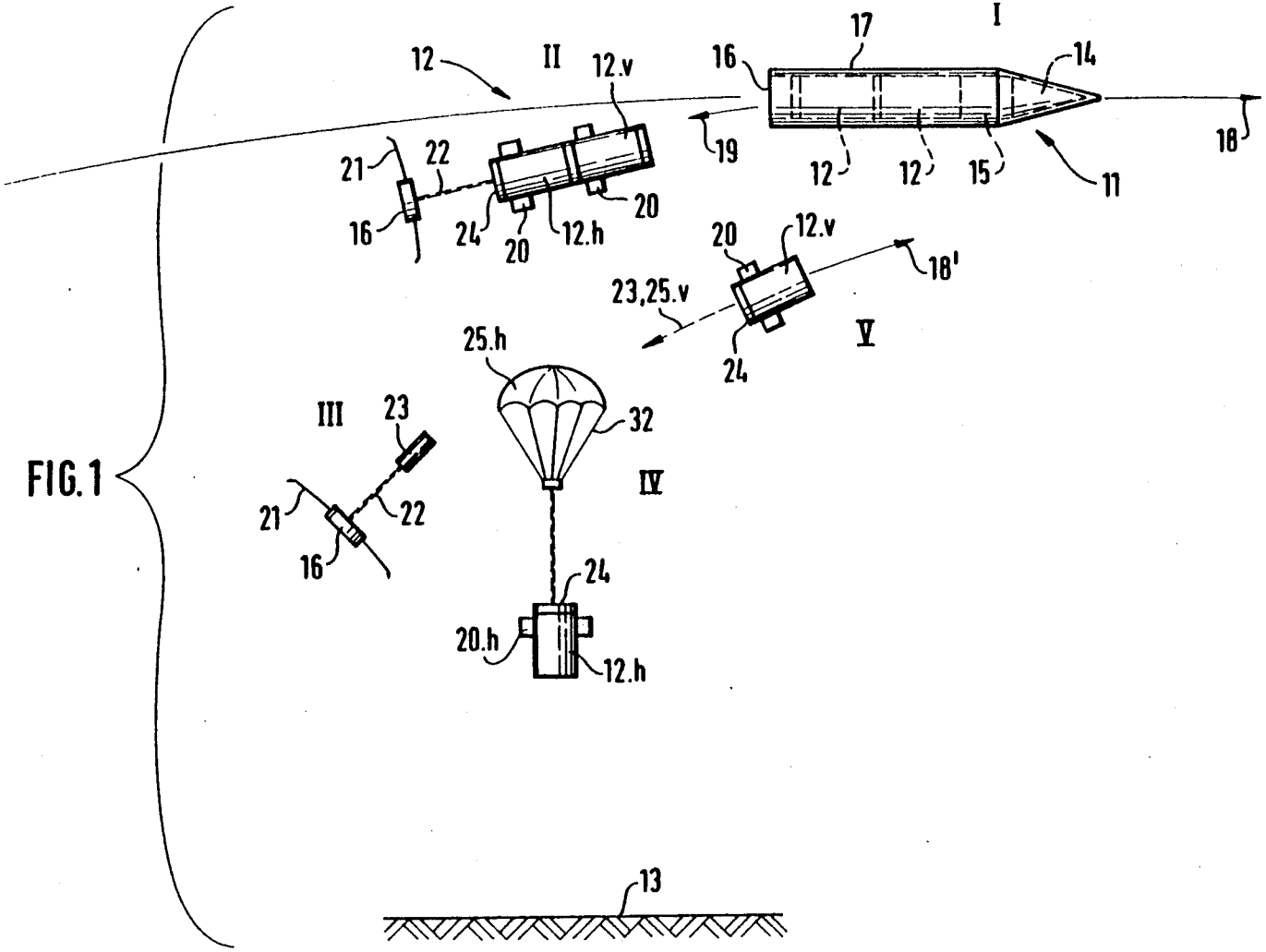
FIG. 1 illustrates, in a diagrammatic pictorial representation, a plurality of successively following operational phases in the dispensing of articles of submunition from an artillery-fired carrier projectile.

The artillery projectile 11 which is illustrated in FIG. 1 in the deployment or delivery phase (I) is designed as a carrier projectile for delivering payloads in the form of at least two articles of submunition 12. The spin-stabilized carrier projectile 11 which is fired over a previously reconnoitered target area 13 will activate in that region, such as by means of a delayed-action or time fuze 14, and with a gas generator 15 for the pushing out of the stack of articles of submunition 12 at the tail end of the projectile through the shearing-off of the tail end 16 of the projectile from the carrier casing 17.

As a result of the spin which is transmitted from the carrier projectile 11 to the articles of submunition 12, these initially maintain in a gyroscopically-stabilized manner their coaxial position, with the continuation of the carrier movement 18 with regard to direction and velocity (the last-mentioned reduces in accordance with the extent of the expulsive movement 19). With the release of the submunitions from the carrier casing 17, flaps 20 provided on the articles of submunition 12 unfold for effectuating the reduction in the spin imparted thereto by the projectile 11. The projectile base 16 is braked with respect to the movement of the articles of submunition 12 through the aerodynamic braking effect of extended braking sails 21 (referring to U.S. Pat. No. 4,753,171), so as to cause a pull line 22 to tension, which line is connected by means of a packing 23 to a braking parachute 25 for the rear article of submunition 12.h, and which is stowed in a parachute cassette 24. Consequently, the parachute 25 (operating phase II through phase III towards phase IV shown in FIG. 1) is pulled out of its rearwardly opened cassette 24 and thereby from the tail end of the rear article of submunition 12.h. The parachute stretches and unfolds itself so as to open and thusly brakes the rear submunition 12.h relative to the carrier movement 18' which is transmitted to the submunitions 12, in view of which the forward article of submunition 12.v will lift away with its tail end from the front surface of the rear article of submunition 12.h. This will cause the tail end of the parachute cassette 24 of the forward submunition 12.v to be released.

In order to avoid any disruptive couplings taking place between the now differing submunition kinematics, no provision is made for any pulling or drawing-connecting line from the rear submunition 12.h to the braking parachute 25 of the forward submunition 12.v. To the contrary, there is primarily utilized the basic suction force which is constantly present behind such a projectile, in order to move the still-packed braking parachute 25 which stands under a static packing pressure, rearwardly out from its cassette 24 so as to enable it to unfold in the incident or oncoming airflow.

When the braking parachute 25 of the forward article of submunition 12.v is at any time prematurely discharged, then the distance to the already braked-down rear article of submunition 12.h is, under circumstances, still so small that, for example, the forward parachute 25.v may be contacted and wound-up or even destroyed by the despinning flaps 20.h. At the very least, the forward submunition 12.v is then no longer able to come into transition into the intended parachute-braked descending flight, but rather will crash down and, consequently, is no longer able to produce any effect in a target object.

In order to avoid the foregoing condition, on the cassette 24 for the submunition 12, whose parachute 25 is not pulled by means of a line 22, there is provided a parachute-releasing device 27 which is subjected to the influence of a retarding element 26. The device 27 may simply consist of flaps 28 which are hingedly connected to the tail end of the cassette 24, which in the region of the tail end-opening of the cassette 24 (FIG. 2) can be radially conducted about behind the stowed (possibly within a packing 23) braking parachute 25, and by means of a tension cord 29 which is pulled through mountings 30 (such as eyelets or hooks) held together against the exposed end surfaces of the releasing flaps 28.

When a separating device 31 (FIG. 3), such as simply a draw pin through closure eyelets, releases the cord 29, then the flaps 28 are extended under the influence of the centrifugal forces of the mountings 30 (or if required, auxiliary weights) due to the rotation of the submunition 12.v and due to the basic suction force-propagated rearward squeezing out of the still packed parachute 25, such that the rearward opening of the cassette 24 is freed for the exit of the parachute 25, and the latter can unfold after tensioning of its cord line 32 which is located in the interior of the cassette 24 (FIG. 1).

In order to prevent the releasing device 27 for the parachute 25 from responding prematurely, the retarding element 26 is only placed into operation when a latch 33 has been released, since the submunition 12.v has exited through the tail end of the carrier casing 17 (FIG. 1). The delay period for the retarding element 26 is constructively set in such a manner that the tension cord 29 for the flaps is only released when a sufficient period of time has elapsed after the exit from the carrier casing 17; in essence, an adequate time interval for the braking of the rear article of submunition 12.h relative to the movement 18' of the forward article of submunition 12.v; so that with assurance the mutual distance is so large that the parachute 25.v of the forward article of submunition 12.v can no longer collide with the already braked rear article of submunition 12.h.

The retarding element 26 can be constructed as an electronic delay circuit or as a pyrotechnic delay composition. However, particularly expedient is the employment of a mechanical embodiment in which there is utilized the still present spin of the submunition 12 which has been released from the carrier projectile 11, in order to avoid the need for supplying a separate energy source for the operation of an electronic timing circuit or for the triggering of a pyrotechnic delay composition.

Figure 3:
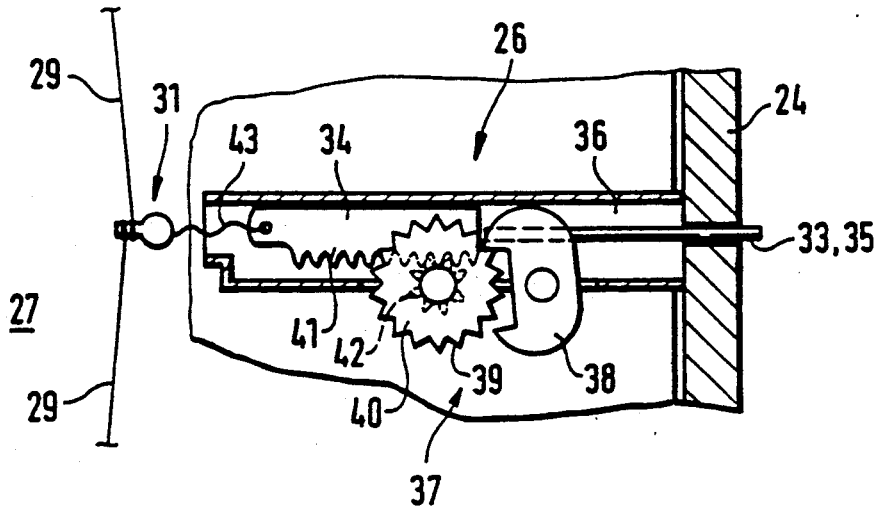
FIG. 3 illustrates a sectional view through a mechanical embodiment for a release-retarding element pursuant to FIG. 2.

For this purpose, pursuant to FIG. 3, there is provided a centrifugal weight 34 which is radially oriented and guided in the cross-sectional plane of the submunition 12, which can move under the influence of the spin-generated centrifugal forces in a direction towards the wall structure of the parachute cassette 24 when a latching pin 35 has freed the path of movement 36, inasmuch as the pin is accelerated radially outwardly after the exit of the submunition 12 from the carrier casing 17 (FIG. 1) and the opening of the heretofore retracted despinning flaps 20. However, the radial movement of the centrifugal weight 34 is braked by means of a retarding mechanism 37, in that (as is known per se from the clock-work mechanism technology) an oscillating escapement 38 will periodically alternatingly block the teeth 39 of an escapement wheel or ratchet 40 in their rotational movement, which is generated through the engagement of gear teeth 41 fastened to the centrifugal weight in an escapement wheel-pinion 42. Only first when the gear teeth 41 due to the correspondingly further radial displacement of the centrifugal or weight 34, is disengaged from the escapement wheel-pinion, can the centrifugal weight 34 move further sudden or impact-like along the linear guidance within its path of movement 36 up to the side of the housing. As a result thereof, there is activated the separating device 31, such as through a pulling out of the draw pin which is illustrated in FIG. 3 for the holding together of the tension cord 29. In order to prevent the commencement of the movement of the centrifugal weight 34 from being hindered by the coupling thereof to the separating device 31, there is expediently provided a coasting operation or free-wheeling therebetween, such as a rope-like connection 43 which is only tensioned for the drawing out of the pin when the gear rod 41 has been disengaged from the ratchet or escapement wheel-pinion 42.

The force which is exerted by the centrifugal weight 34 against the retarding mechanism 37, and as a result the centrifugal motion of the weight 34, is dependent upon the centrifugal force; in effect, upon the spin which the submunition 12 possesses during exit from the carrier casing 17, when the latch 33 is eliminated. Inasmuch as the carrier projectile 11 is fired from rifled weapon barrel; in essence, the spin depends upon the muzzle velocity, and thereby also the subsequent carrier movement 18, this signifies that the release of the separating device 31 for the emitting of the braking parachute 25 becomes greater in the direction of the carrier movement 18 at a lower velocity. This is constantly desired, inasmuch as this will ensure that, notwithstanding a slower advancing movement of the forward submunition 12v away from the already braked rear submunition 12.h (FIG. 1), there is nevertheless attained a sufficient distance therebetween prior to the forward braking parachute 25 being released, without necessitating for the functioning of the retarding element 26 any control by means of a separate speed sensor or spin sensor.

Figure 2:
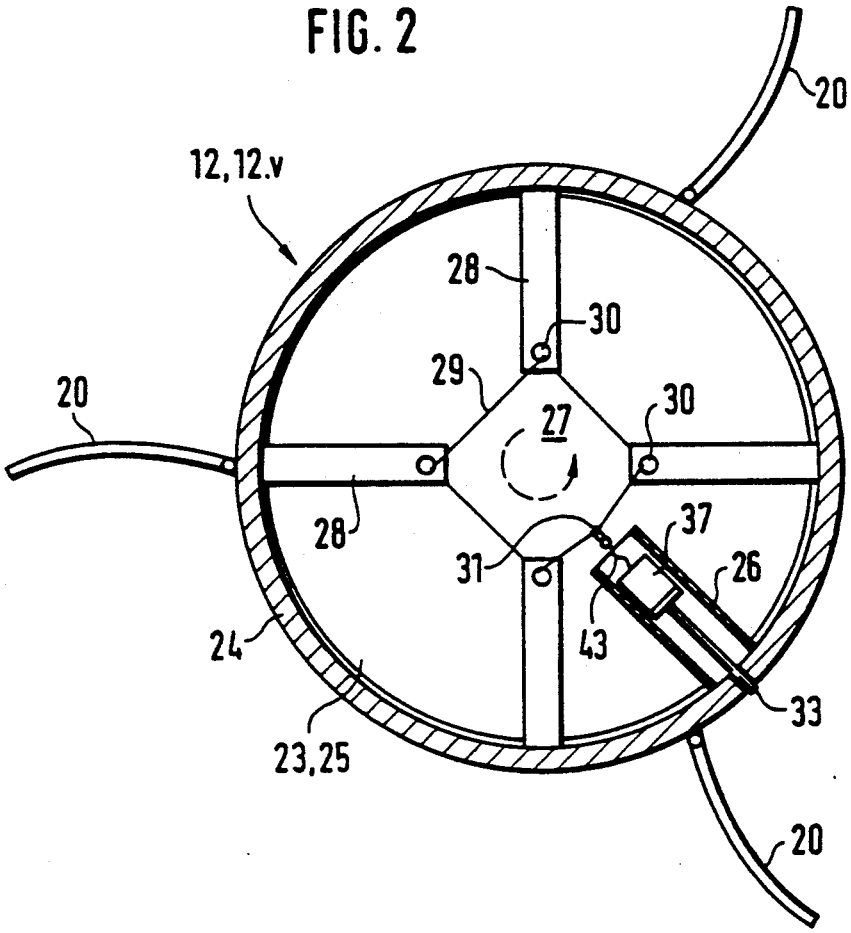
FIG. 2 illustrates, partly in section, a tail end view of an article of submunition with a braking parachute which has not yet been released.

In essence, elucidating the functioning of the arrangement as described, having particular reference to FIG. 2 of the drawings, the packed parachute 25 is located on the bottom of the cup-shaped cassette 24, and located thereabove, in effect, in the plane of the drawing, the parachute-releasing device 27, incorporating components 28, 29 and 31. The parachute-releasing device 27 is initiated when the pin 33 is propelled outwardly in a radial direction under the action of centrifugal force, inasmuch as the article of submunition 12 has been released from the encompassing carrier projectile 11; however, in contrast with this release in a time-delayed manner through the interconnection of the retarding element 26, containing components 37, 43 and 31. The components 28, 29 of the parachute-releasing device 27 must always be located behind the packed parachute 25 for as long as the latter should not exit rearwardly from its cassette 24. Although in different planes, in FIG. 2 also the retarding element 26 is represented in this drawing plane; meaning, it swings up the flaps 28 out of the drawing plane when the pin of the separating device 31 has been pulled, in order to permit the parachute 25 to exit rearwardly from the cassette 24.

Hereby, when the retarding element 26 lies below the drawing plane shown in FIG. 2, in effect in the direction of flight of the projectile 11, ahead of the packed parachute 25 on the bottom of the cassette 24, then naturally the cord 29 must be drawn parallel to the axis of the cassette 24 (in effect, perpendicular to the plane of the drawing) through the packed parachute 25 or along the edge thereof forwardly towards the retarding element 26 on the cassette bottom; or, the connecting cord 43 extends from the cassette bottom axially parallel through the cassette 24 rearwardly into the plane of the drawing for the tension cord 29 behind the packed parachute 25. Hereby, it is always essential that with the termination of the delay which is caused by the retarding element 26, the cord 29 is separated so that the parachute 25 as a result of the vacuum which is caused by the flow rearwardly of the cassette 24 will exit rearwardly from the cassette and is enabled to unfold.

For a simplification in the illustration and elucidation it is assumed in FIG. 2 of the drawings that the retarding element 26 is generally hingedly connected in the cross-sectional plane of the deceleration flaps 28 in the rearward opening of the cassette 24 to the flaps, about which the flaps 28 are extended axially-parallel in response to the centrifugal force when the tension cord 29 is braked. However, more expediently, there can be provided a mechanically somewhat more stable mounting on the (located in front of the packed parachute 25) base of the rearwardly open cassette 24, with a radial guidance for the tension cord 29 or of the separating device 31 for the axially-parallel elevated bridging over above the shallow hollow-cylindrical parachute packing cassette 24.

What is claimed is:

1. Artillery projectile-delivered article of submunition including release means for a braking parachute stowed in the tail end region of said article of submunition; a retarding element operatively connected to said release means for activating said release means, said retarding element including operative structure for activation thereof responsive to the exit of the article of submunition from a casing of the carrier projectile contacted by said operative structure, said release means including a tension cord extended behind the braking parachute in the packed condition of said parachute; and separating means for releasing said tension cord in response to the influence of said retarding element being exerted thereon upon exit from said casing.

2. Submunition as claimed in claim 1, wherein rope-like connecting means forms a connection between the separating means and said retarding element so as to exert a force on said separating means only subsequent to the freeing of the radial movement of said centrifugal weight.

3. Submunition as claimed in claim 1, wherein a draw pin forms said separating means for the release of the parachute tension cord.

4. Submunition as claimed in claim 1, wherein said retarding element includes a centrifugal weight guided within a radially oriented path of movement; and restraining means for transiently braking the radial movement of said centrifugal weight prior to the response of said separating means.

5. Submunition as claimed in claim 4, including a latching pin forming latch means for initiating operation of the retarding element, said pin being radially withdrawable out of the path of movement of the centrifugal weight.

6. Submunition as claimed in claim 4, wherein said radially guided centrifugal weight is in engagement through a gear rod with a pinion on an escapement wheel.

* * * * *